United States Patent [19]

Grehl

[11] 4,087,930

[45] May 9, 1978

[54] MAGAZINE CAP RETAINING MEANS FOR TUBULAR MAGAZINE FIREARMS

[75] Inventor: William H. Grehl, Wallingford, Conn.

[73] Assignee: O. F. Mossberg & Sons, Inc., North Haven, Conn.

[21] Appl. No.: 734,294

[22] Filed: Oct. 20, 1976

[51] Int. Cl.[2] ..... F41C 27/00; F41C 25/08

[52] U.S. Cl. ..... 42/75 B; 42/49 R

[58] Field of Search ..... 42/49 R, 75 A, 75 B, 42/75 C, 17

[56] References Cited

U.S. PATENT DOCUMENTS

| | | | |
|---|---|---|---|
| 816,015 | 3/1906 | Johnson | 42/75 B |
| 819,550 | 5/1906 | Johnson | 42/75 B |
| 1,057,170 | 3/1913 | Redfield | 42/17 |
| 2,402,086 | 6/1946 | Rix | 42/75 B |
| 2,719,375 | 10/1955 | Crittendon et al. | 42/17 |
| 2,891,341 | 6/1959 | Crittendon et al. | 42/75 C |
| 3,163,952 | 1/1965 | Into | 42/75 B |

*Primary Examiner*—Charles T. Jordan

*Attorney, Agent, or Firm*—St. Onge, Mayers, Steward & Reens

[57] ABSTRACT

A detent device for a magazine cap on a tubular-magazine firearm, in which the magazine spring is employed to urge a detent member at the front end of the magazine into engagement with a detent surface inside the cap in order to prevent accidental loosening of the cap.

3 Claims, 4 Drawing Figures

MAGAZINE CAP RETAINING MEANS FOR TUBULAR MAGAZINE FIREARMS

BACKGROUND OF THE INVENTION

The present invention relates to firearms, and it relates more particularly to the type of firearm having a tubular magazine disposed within a fore-end grip beneath the barrel. Specifically, the invention relates to a detent device for preventing accidental loosening of the cap which covers the front end of the magazine tube.

In some types of shoulder arms, such as repeating shotguns which employ tubular magazines, the magazine is enclosed within a so-called fore-end grip, which is usually made of wood. It is common practice to form the grip so that it can be slipped longitudinally over the front end of the magazine and seated against the front end of the receiver or other portion of the gun. A cap is then threaded onto the end of the magazine tube projecting forward of the grip and tightened until it firmly engages an end surface of the grip and drives it rearward against the receiver, thereby holding the grip rigidly in place.

Likewise, in so-called pump-action guns a magazine cap may be provided which engages a bracket fixed to the barrel of the gun by which the front portion of the magazine is supported. In such arrangements the cap alone ordinarily holds the barrel in place instead of the fore-end grip, which in this case is slidably mounted for manually reloading and cocking the gun.

In these types of firearms, it is desirable to provide some means for preventing accidental loosening of the magazine cap while the gun is being used. To this end, a spring-loaded detent ball or plunger may be mounted either in the end surface of the grip for engagement with a ribbed or serrated surface on a peripheral portion of the cap, or in the case of pump-action guns, in the cap where it can engage a serrated surface on the magazine-mounting bracket.

The object of the present invention is to provide an improved detent for a magazine or fore-end cap in a tubular-magazine firearm, one purpose being to provide more positive action of the detent member than has been practical heretofore with conventional detents.

SUMMARY OF THE INVENTION

The invention resides in the provision of a detent member having a base portion with one or more fingers projecting from it, the base portion being disposed at the front end of the magazine tube between the magazine spring and an apertured retainer for such spring, with the finger or fingers of the detent member extending through the retainer into engagement with the magazine cap when it is threaded onto the end of the magazine tube. As the cap is tightened it pushes against the end of the finger, forcing the base of the detent member against the magazine spring, which in turn resiliently urges the finger of the detent member into engagement with a detent surface associated with the cap for preventing inadvertent rotation of the cap. An important advantage of the invention is that a more effective means for preventing loosening of the magazine cap is provided than has been feasible heretofore with conventional spring detents. Furthermore, it is more rugged and therefore less susceptible to wear than conventional detent means without increasing manufacturing costs.

DETAILED DESCRIPTION OF PREFERRED EMBODIMENT

Figure 1:
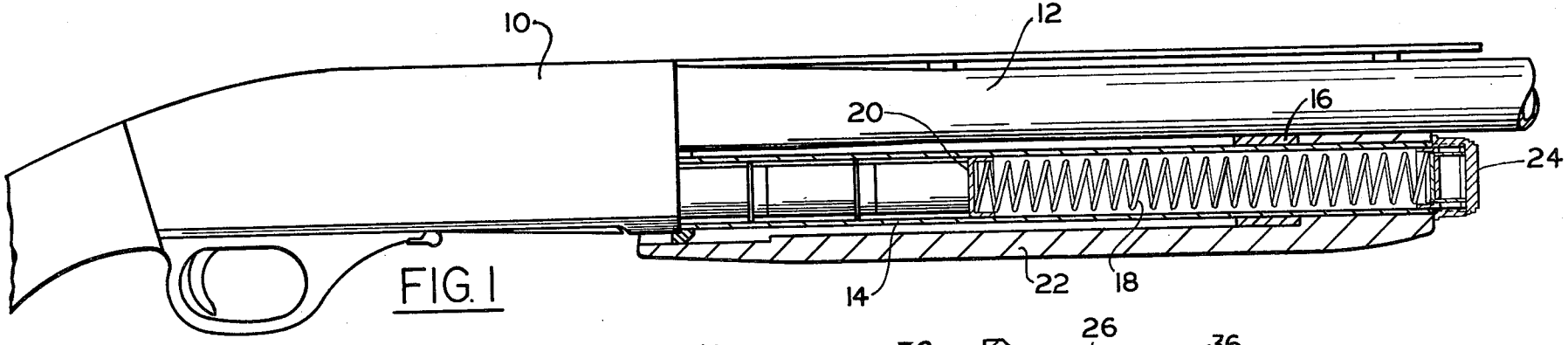
FIG. 1 is a fragmentary side elevational view of a tubular magazine shotgun embodying the invention, portions thereof being shown in vertical section.

The shotgun shown in FIG. 1 for illustrative purposes includes a receiver 10, a barrel 12 and a tubular magazine 14, one end of which fits into an opening in the receiver for feeding shotgun shells to the reloading mechanism within the receiver. Magazine 14 is rigidly connected at its rear end to the receiver by suitable means such as staking and is supported adjacent its other end in a cylindrical bracket 16, which is brazed or otherwise permanently mounted on the underside of barrel 12. A magazine spring 18 within magazine 14 presses rearwardly against a cartridge-follower cup 20 which in turn continuously exerts a rearward pressure against the column of shotgun shells.

A conventional fore-end grip 22 is shown in FIG. 1 substantially completely surrounding the magazine 14, with a fore-end cap 24 threaded onto the end of magazine 14 which projects a short distance beyond the front of the grip. Cap 24 engages the end of grip 22 and forces it rearward against the receiver 10, thereby holding the grip securely in place. By unscrewing cap 24 and removing it from the threaded end of magazine 14, the fore-end grip 22 may be slid forward over the magazine in order to expose the magazine tube, as well as other portions of the gun. This general arrangement of the fore-end portion of a tubular-magazine firearm is typical of semi-automatic shoulder guns, but as indicated hereinbefore, the invention is also applicable to other types of tubular-magazine firearms, such as pump or slide-action guns in which the fore-end is movable longitudinally for reciprocating the breech-bolt and actuating the reloading mechanism.

Figure 2:
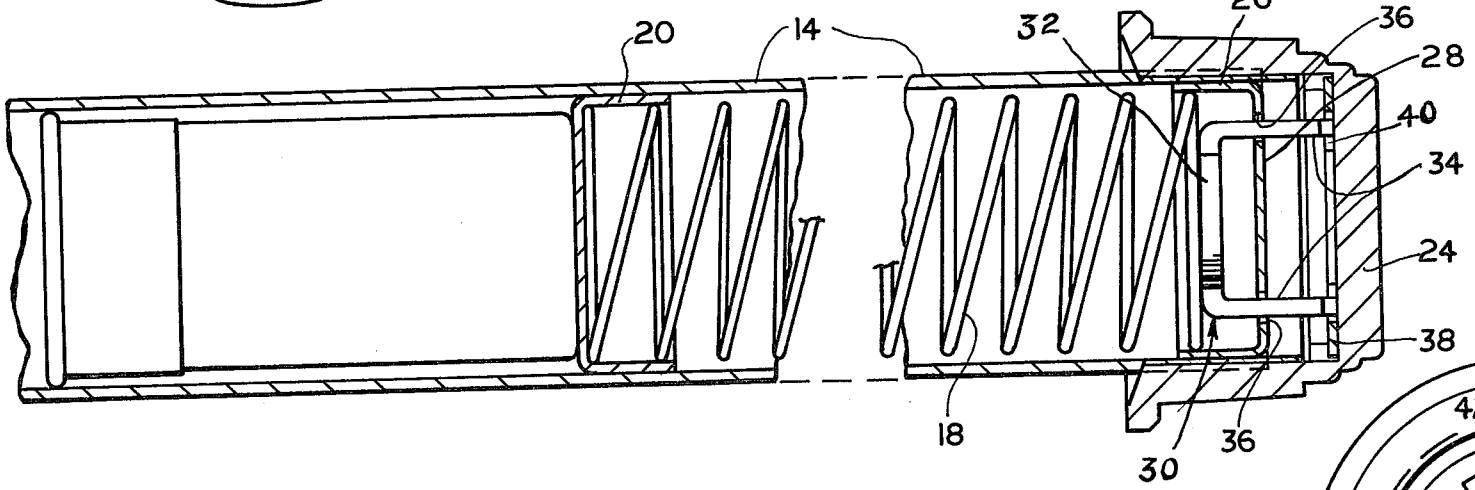
FIG. 2 is an enlarged detail view in vertical section of the front portion of the magazine tube with the fore-end grip removed and showing the fore-end cap threaded onto the end of the magazine tube.

Referring now more particularly to FIG. 2, the magazine tube 14 is provided at its front end with an apertured spring retainer 26 for holding the outer end of magazine spring 18. Retainer 26 is a cup-shaped member which fits into the open end of magazine tube 14 and is suitably held therein against movement, as for example by a force fit with the magazine. Interposed between the bottom or base 28 of retainer 26 and the end of the magazine spring 18 is a detent member 30, which has a base-plate 32 that fits transversely within magazine tube 14 and a pair of forwardly projecting prongs or fingers 34, 34, which pass through a pair of spaced openings 36, 36 in the bottom 28 of retainer 26. Portions of the base-plate 32 of detent member 30 extend transversely into sliding engagement with the inner walls of magazine tube 14 and are circularly formed to match the cylindrical surface of the magazine tube, against which they ride. Accordingly, magazine spring 18 continuously urges detent member 30 toward retainer 26 with the prongs 34, 34 extending through the retainer into engagement with the bottom of fore-end cap 24.

Figure 4:
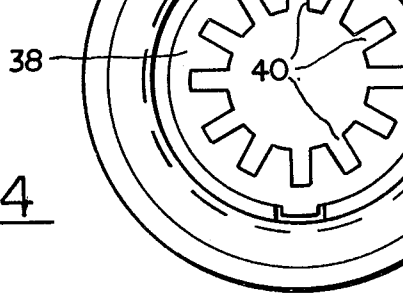
FIG. 4 is an end view of the fore-end cap looking into the open end thereof.
Figure 3:
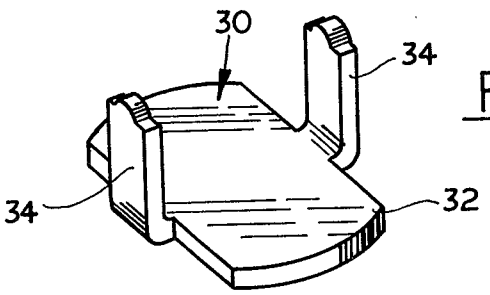
FIG. 3 is a perspective view of the detent member.

Disposed transversely of, and in the bottom of cap 24 is a detent ring 38, which has a plurality of slots or notches 40 (FIG. 4), extending radially outward from its inner periphery for receiving and retaining the rounded ends of prongs 34, 34 in any desired position of rotation of the cap 24 on tube 14. Ring 38 is provided on its outer periphery with a pair of oppositely disposed tabs 42, 42 which fit within corresponding retaining notches inside cap 24 for preventing rotation of ring 38 with respect to cap 24. It will of course be understood that, if desired, the detent slots 40 could of course be formed directly in the bottom of cap 24 instead of by means of the ring 38. Use of the ring 38, however, provides a convenient and effective way of providing the necessary detents in the cap.

It will be noted that ends of prongs 34, 34 of the detent member 30 are rounded so that they do not lock within slots 40 and positively prevent rotation of the fore-end cap, the purpose of the detent being only to prevent it from rotating until sufficient torque is applied to overcome the pressure of the magazine spring 18. Accordingly, cap 24 may be screwed onto or off of the magazine tube 14, but is resiliently prevented by the detent member 30 from loosening accidentally.

When cap 24 is removed by completely unscrewing it so that the fore-end grip 22 can be removed, the detent member 30 moves forward under the pressure of the magazine spring until its base-plate 32 rests against the bottom 28 of spring retainer 26, which prevents the magazine spring from escaping.

What is claimed is:

1. In a firearm having a magazine tube, a magazine spring for urging cartridges in said magazine tube toward one end thereof and a magazine cap threaded to and closing the other end of said tube, a detent device for restraining said magazine cap against loosening on said tube comprising an apertured spring-retainer fixed within said tube at said other end for retaining said magazine spring, a detent member having a base portion with at least one finger projecting therefrom, said base portion being disposed between said magazine spring and said retainer such that said magazine spring urges said detent member toward said retainer, said finger projecting through said apertured retainer into engagement with said magazine cap when said cap is threaded onto said tube, such that said cap forces said detent member against said magazine spring as said cap is tightened, said detent member being fixed against rotation by said spring-retainer, and detent surface means associated with said cap and disposed for engagement by the free end of said finger, whereby said finger restrains said cap against accidental rotation.

2. A detent device for a magazine cap as defined in claim 1, wherein said detent member is provided with a pair of said fingers spaced from each other transversely of said magazine tube, said spring-retainer having a pair of correspondingly spaced openings through which said fingers extend.

3. A detent device for a tubular-magazine fore-end cap as defined in claim 2, wherein said detent surface means comprises a detent ring disposed transversely within said cap and having a plurality of radially extending slots on its inner periphery disposed for engagement by said fingers, and means for preventing rotation between said detent ring and said cap.

* * * * *